US005351724A

United States Patent [19]

Zenoni et al.

[11] Patent Number: 5,351,724

[45] Date of Patent: Oct. 4, 1994

[54] ELECTROPNEUMATIC DEVICE FOR THE AUTOMATIC THREADING OF A WEFT FEEDING APPARATUS

[75] Inventors: Pietro Zenoni; Giovanni Pedrini, both of Leffe; Rosario Castelli, Gandino, all of Italy

[73] Assignee: L.G.L. Elettronica S.p.A., Bergamo, Italy

[21] Appl. No.: 45,574

[22] Filed: Apr. 9, 1993

[30] Foreign Application Priority Data

Apr. 22, 1992 [IT] Italy ..... TO92A000353

[51] Int. Cl.[5] ..... D03D 47/34

[52] U.S. Cl. ..... 139/452

[58] Field of Search ..... 139/452

[56] References Cited

U.S. PATENT DOCUMENTS

| | | | |
|---|---|---|---|
| 5,072,760 | 12/1991 | Kaufman | 139/452 |
| 5,094,275 | 3/1992 | Shaw et al. | 139/452 |
| 5,109,891 | 5/1992 | Maina | 139/452 X |
| 5,123,455 | 6/1992 | Maina | 139/452 |
| 5,181,544 | 1/1993 | Deiuri | 139/452 |
| 5,201,346 | 4/1993 | Cox | 139/452 X |

FOREIGN PATENT DOCUMENTS

| | | |
|---|---|---|
| 0436900 | 7/1991 | European Pat. Off. . |
| 0446447 | 9/1991 | European Pat. Off. . |
| 0450686 | 10/1991 | European Pat. Off. . |
| 8902944 | 4/1989 | PCT Int'l Appl. . |

OTHER PUBLICATIONS

Patent Abstracts of Japan-vol. 8, No. 274 (M-345) (1711) Dec. 14, 1984 & JP-A-59 143 867-abstract.

*Primary Examiner*—Andrew M. Falik

*Attorney, Agent, or Firm*—Guido Modiano; Albert Josif; Daniel O'Byrne

[57] ABSTRACT

An electropneumatic device for the automatic threading of apparatuses for feeding weft to textile machines, and a weft feeding apparatus including the device. The device has first and second ducts for feeding pressurized pneumatic fluid. The ducts are cut off by a manually-actuated valve and end in thread inlet and outlet bushes to create a pneumatic flow and a consequent suction current which entrains the thread from one end of the feeder apparatus to the other. An intermediate open channel is arranged adjacent and parallel to the drum of the apparatus to convey the pneumatic flow and the thread entrained thereby in the free portion comprised between the radial arm outlet and a thread brake. A pneumatic pusher is fed by a third pneumatic duct and is arranged at the outlet of the intermediate channel. The pusher acts on a braking device to deform it and hinder elastic action applied to the drum, so as to guide the thread entrained by the flow through the braking device.

19 Claims, 3 Drawing Sheets

ELECTROPNEUMATIC DEVICE FOR THE AUTOMATIC THREADING OF A WEFT FEEDING APPARATUS

BACKGROUND OF THE INVENTION

The present invention relates to an electropneumatic device for the automatic and complete threading of apparatuses for feeding weft to textile machines and to a weft feeding apparatus which includes said device.

As is known, weft feeders are apparatuses which are suitable to draw the weft thread from spools, to accumulate a reserve of weft in the form of turns of thread wound around a fixed drum and to feed said thread to the textile machine, for example a gripper or bullet loom, with a controlled and constant tension and in an amount linked to the demand of the machine itself.

For this purpose, weft feeders comprise, according to a known arrangement, a fixed drum at the base of which a ring is rotatably arranged; said ring is provided with a radial or substantially radial hollow arm in which the thread runs and, by virtue of the rotation of the ring, winds on drum, forming the turns of the weft reserve. The thread reaches the cavity of the radial arm by passing in a similar cavity of the drive shaft of the disk and unwinds from the drum by passing through a braking means which is in elastic contact with the drum and with a terminal thread guiding ring which is arranged coaxially to said drum; ceramic inlet, intermediate and outlet bushes are provided respectively at the inlet of the drive shaft of the ring, at the outlet of the hollow radial arm and on said terminal thread guide.

When the spool located upstream of the pre-feeder ends, or when the thread breaks, the weft reserve is correspondingly depleted and it is necessary to rethread the feeder. Due to the convoluted shape of the path of the thread, and especially to the obstacle constituted by the braking means, the threading operation is performed manually, at least in the front part of the apparatus which is comprised between the intermediate bush and the outlet bush by using a tool, commonly termed "drawboy", which consists of a flexible metallic wire which can follow the path of the thread and at the head of which there is an eye or another means for connecting the thread.

In practice, the drawboy is inserted in the pre-feeder, from the front side, through the bush of the thread guide and the braking means, and then the thread is connected to the head of the drawboy; by pulling back the drawboy from the front side, the thread is fully threaded in the pre-feeder; the threading of the rear part of the apparatus, comprised between the inlet bush and the intermediate bush, is performed in a known manner by means of a pressurized pneumatic fluid.

The use of the drawboy is quite onerous, requires considerable specialization on the part of the operator but, most of all requires a considerable time for execution, which negatively affects the efficiency of the loom or textile machine.

The prior international application WO 89/02944 already described a device which eliminates the use of the drawboy by performing automatic threading in the front part of the apparatus by means of a wall of pressurized fluid, generated by annular nozzles and/or by tubular ducts, which passes through the braking means. The described arrangement assumes, however, that the braking means surrounds the drum so that there is a free annular gap between said braking means and said drum, as in the case of FIG. 1 of said application, or an annular gap affected by a ring of bristles, as in the case of FIG. 2 of the same application.

However, this known arrangement is unsuitable to produce threading through a continuous braking means which frontally and elastically adheres to the drum of the apparatus, for example a braking means of the kind described in U.S. Pat. No. 5,316,051 in the name of the same Applicants, since such a braking means interacts with the wall of fluid and with the thread entrained it, preventing its transit.

SUMMARY OF THE INVENTION

The aim of the present invention is to eliminate this drawback and, within the scope of this general aim, it has the important object of providing a device which can perform automatically, without any manual intervention, the complete threading of feeders of any kind and in particular of the kind which comprises a continuous braking means which adheres elastically to the drum of the apparatus.

Another object of the present invention is to provide an automatic threading device which is structural simple, highly reliable in operation and suitable to thread any kind of thread.

In order to achieve this aim, these objects and others which will become apparent from the following detailed description, the present invention relates to a threading device for weft feeders of the specified type, which comprises: a first duct and a second duct for feeding pressurized pneumatic fluid, said ducts being affected by manually actuated valve means and ending respectively at the rear inlet bush and at the front outlet bush of the thread to create a pneumatic flow and a consequent suction current which entrains said thread from one end of the feeder apparatus to the other; an intermediate open channel, which is arranged adjacent and parallel to the drum of the apparatus to convey the pneumatic flow in the free portion comprised between the outlet of the radial arm and the braking means; a pneumatic pusher, which is arranged at the outlet of the intermediate channel and acts on the braking means to deform it and hinder its elastic action applied to the drum and to guide the thread entrained by the pneumatic flow through said braking means; and position-marking means to align the outlet of the radial arm with the intermediate channel in order to convey the pneumatic flow and guide the thread entrained by said flow when the threading device is activated.

BRIEF DESCRIPTION OF THE DRAWINGS

Further characteristics, purposes and advantages will become apparent from the following detailed description and with reference to the accompanying drawings, given by way of non-limitative example, wherein.

DESCRIPTION OF THE PREFERRED EMBODIMENTS

Figure 1:
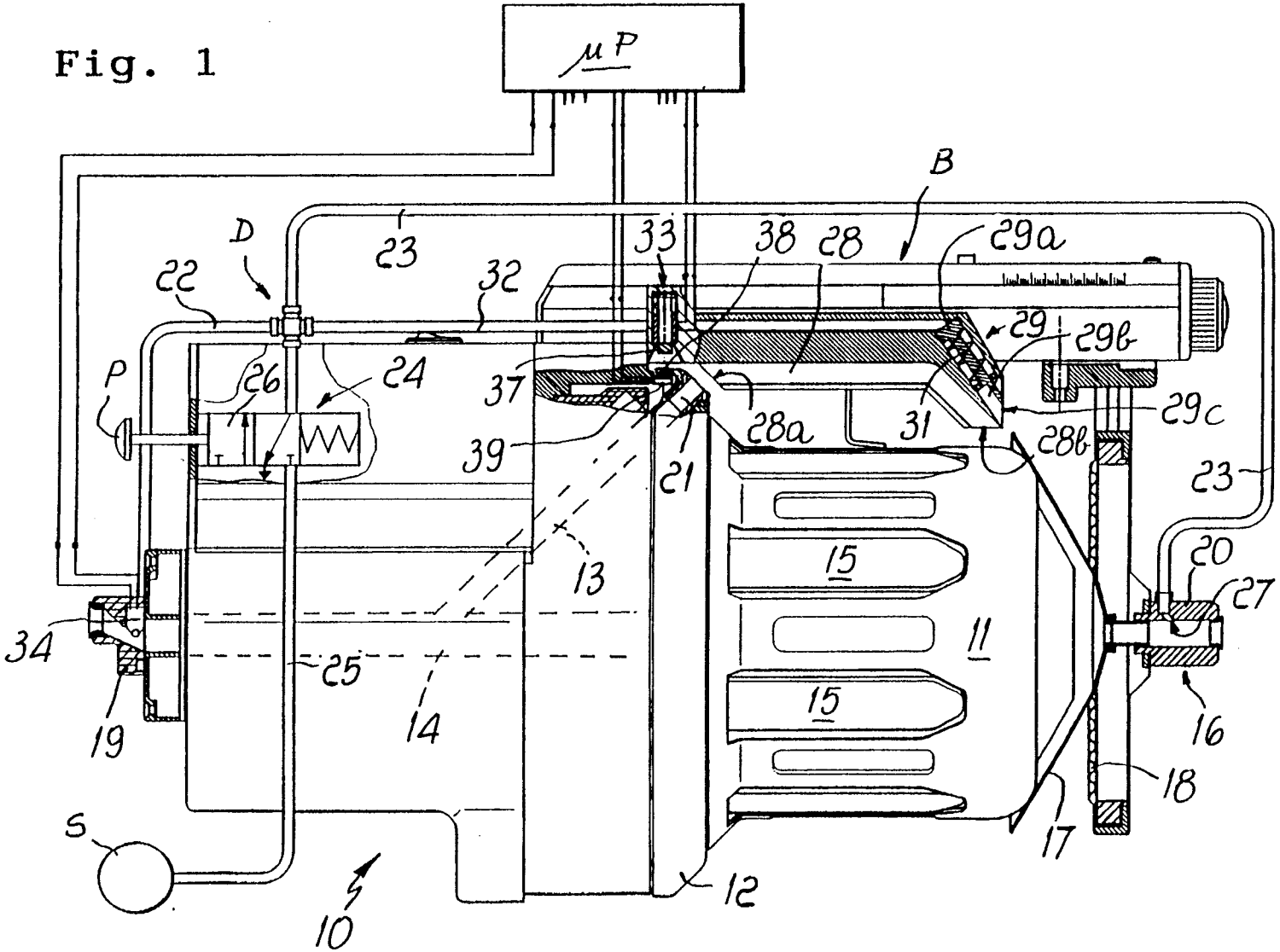
FIG. 1 is a partially sectional elevation view of a weft feeder apparatus with the threading device according to the invention, the threading device being shown in inactive configuration.
Figure 2:
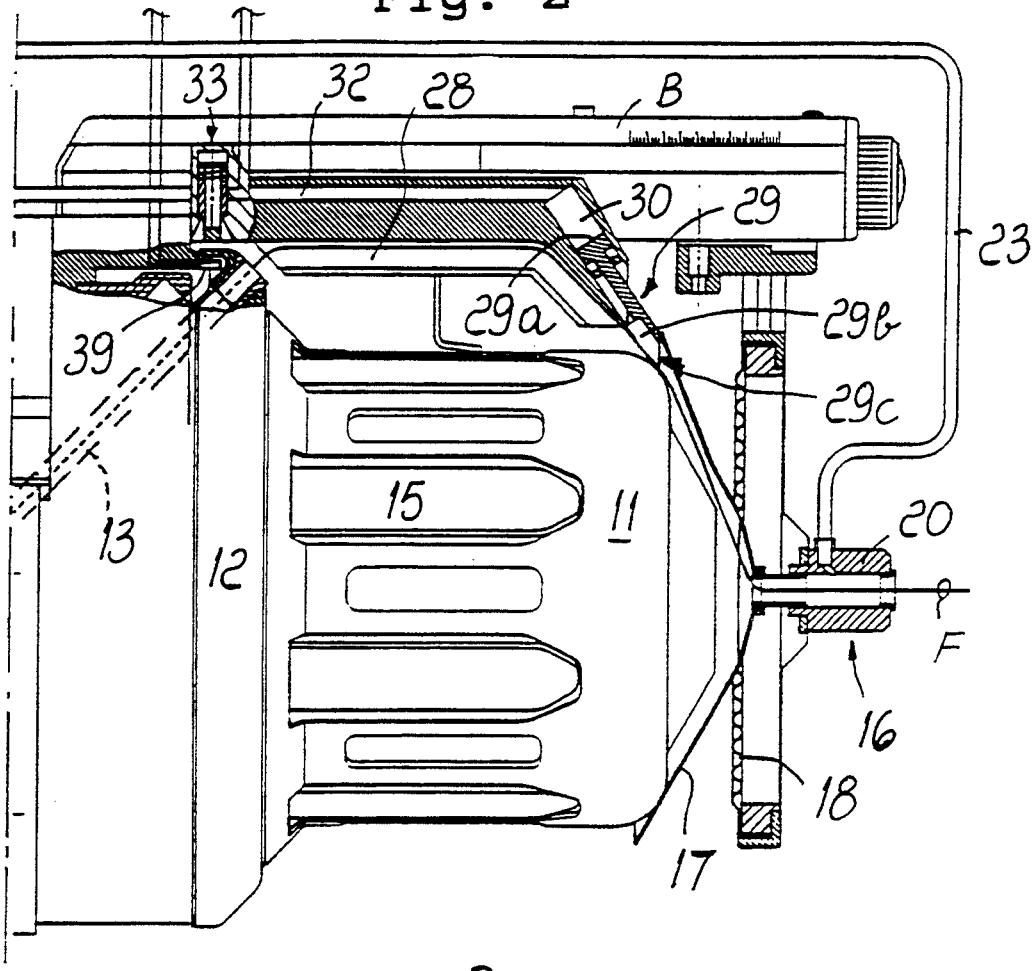
FIG. 2 is a partial elevation view, similar to FIG. 1, illustrating the device in active configuration.
Figure 3:
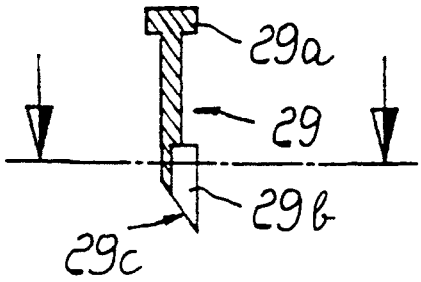
FIG. 3 is an enlarged-scale view of a detail of FIG. 1.
Figure 5:
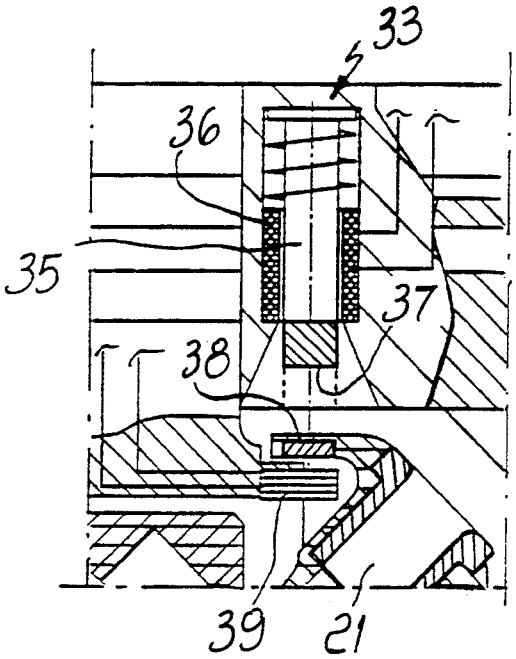
FIG. 5 is an enlarged-scale view of another detail of FIG. 1.
Figure 4:
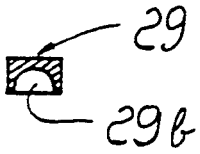
FIG. 4 is a sectional view, taken along the plane IV—IV of FIG. 3.

With reference to FIGS. 1 to 5, the reference numeral 10 generally designates a weft feeder apparatus of the type which comprises a fixed drum 11 at the base of which a ring 12 is rotatably arranged; the ring is provided with a hollow radial arm 13 which is connected to a corresponding cavity of the drive shaft 14 of the ring 12. In a per se known manner, the arm 13, by virtue of the rotation of the ring 12, winds the thread F on the drum 11, forming a weft reserve (not shown) in the form of turns of thread which are made to advance toward the head of the drum by an oscillating-plate device 15 which is also per se known.

The thread which unwinds from the drum, passing in a thread guide 16 which is coaxial to the drum itself, is subjected to tension caused by the braking means, for example of the type described in the above mentioned prior application in the name of the same Applicants, constituted by a semirigid conical element 17 which is supported and pushed into elastic contact engagement with the drum 11 by an elastic membrane 18 which is in turn supported so that it can be adjusted axially by a rigid arm B which is adjacent to the drum 11; said conical element is tangent to the drum at a section which is adjacent to the one where the circumference is greatest. At the end of the drive shaft 14 there is a ceramic bush 19 for the entry of the thread, and similarly on the thread guide 16 there is a ceramic bush 20 for the exit of the thread. A third intermediate bush 21 is arranged at the outlet of the radial arm 13.

According to the present invention, an electropneumatic device D is provided which is suitable to automatically and completely thread the apparatus 10, complete threading being defined as the passage of the thread from the bush 19 to the bush 20 through the intermediate bush 21 and the braking means 17. The device according to the invention comprises a first pneumatic duct 22 and a second pneumatic duct 23 which are cutoff by a monostable valve means 24 and end respectively in the bushes 19 and 20. A duct 25 feeds the pressurized pneumatic fluid, supplied by a source S which is constituted for example by a compressor or by a tank of pressurized fluid, to the valve means 24; a self-releasing button P moves the shutter 26 of the valve means 24 to feed or respectively interrupt the flow of pressurized pneumatic fluid to the ducts 22–23 and to a third duct 32 which will be described hereinafter.

The pneumatic fluid fed into the bushes 19–20 creates a flow which is directed from the inlet to the outlet of the apparatus 10 by virtue of the corresponding orientation of the fluid distribution nozzles 27 inside said bushes, and creates a consequent current for the entrainment of the thread F which is directed from the inlet to the outlet of the apparatus 10. In order to convey said flow and the thread entrained by it in the free portion comprised between the bush 21 and the braking means 17, there is an open intermediate channel 28 whose profile is substantially U-shaped; the channel is arranged so that its opening is adjacent and parallel to the drum 11. The channel 28 has an inlet section 28*a* adjacent to the intermediate bush 21 and an outlet section 28*b* which is adjacent to the braking means 17 and is inclined along the tangent to the head of the drum 11 which passes substantially through the coupling point of said braking means.

At the outlet section 28*b*, the channel 28 includes a pusher element 29 which is capable of elastically deforming the braking means 17, so as to space it from the drum 11, to hinder its elastic braking action applied to the thread F and allow the passage of said thread entrained by the pneumatic flow. The pusher element 29 comprises a plunger 29*a* which can slide tight in a pneumatic cylinder 30 defined in the body of the channel 28, with a stem which ends with a concave U-shaped finger 29*b* which is suitable to engage the edge of the braking means to move it in the specified manner.

As clearly shown in FIG. 1, the U-shaped finger 29*b* is inclined so that it is substantially parallel to the generatrices of the conical braking means 17, and is chamfered by a radial cut 29*c* which acts as a deforming inclined plane for the free edge of the braking element. The concavity of the finger 29*b* is directed toward the drum 11, and said finger constitutes, when the pusher 29 is in active position, an extension of the channel 28 through the braking means 17, in terms both of the conveyance of the pneumatic fluid and of the guiding of the thread.

A spring 31 keeps the concave U-shaped finger normally in a position in which it is disengaged from the braking means and the duct 32 feeds pneumatic fluid to the cylinder 30 so as to move the plunger 29*a* against the action of the spring 31 and deform the braking means 17. In order to establish the pneumatic flow through the channel 28, said channel must be aligned with the bush 21 of the radial arm 13 when the button P of the valve means 24 is pressed to feed the pneumatic fluid to the ducts 22, 23 and 32.

For this purpose there is an electromagnetic position-marking element 33 which is energized when a piezoelectric sensor 34, associated with the inlet bush 19, indicates there is no tension in the thread F due either to breakage or to depletion of the thread itself.

The element 33 (FIG. 5) comprises a movable radial pin 35 and a coil 36 which, when energized, moves the pin toward the ring 12.

At the end of the pin 35 there is a permanent magnet 37 which has a preset polarity and which, by virtue of the movement of the pin 35, is transferred proximate to, but spaced from, the ring 12 so as to interact with a corresponding permanent magnet 38 of opposite polarity provided on said ring 12. When a piezoelectric sensor 34 indicates lack of tension on the thread, a microprocessor $\mu$P associated with the apparatus 10 stops the motor which drives the ring 12 to supply it immediately thereafter with a minimum voltage which corresponds to a minimum speed of the ring 12.

Simultaneously, the microprocessor $\mu$P energizes the coil 36 which lowers the pin 35. In this manner, when the two magnets 37 and 38 are aligned, the ring 12 stops and remains in the preset position; a proximity sensor 39, which is associated with the magnet 38 and interacts with the magnet 37, cuts power to the motor of the ring 12.

The aligned position of the magnets 37 and 38 also corresponds to the alignment between the bush 22 and the channel 28, and therefore, by pressing the button P one produces the pneumatic flow which entrains the thread from the inlet bush 19 to the outlet bush 20 through the bush 21, the channel 28 and the braking means 17, which is loosened by the action of the pusher element 29, which is also activated by the valve means 24. By virtue of this pneumatic flow, the thread F is guided along the path shown in FIG. 2 and the apparatus is threaded completely.

Figure 6:
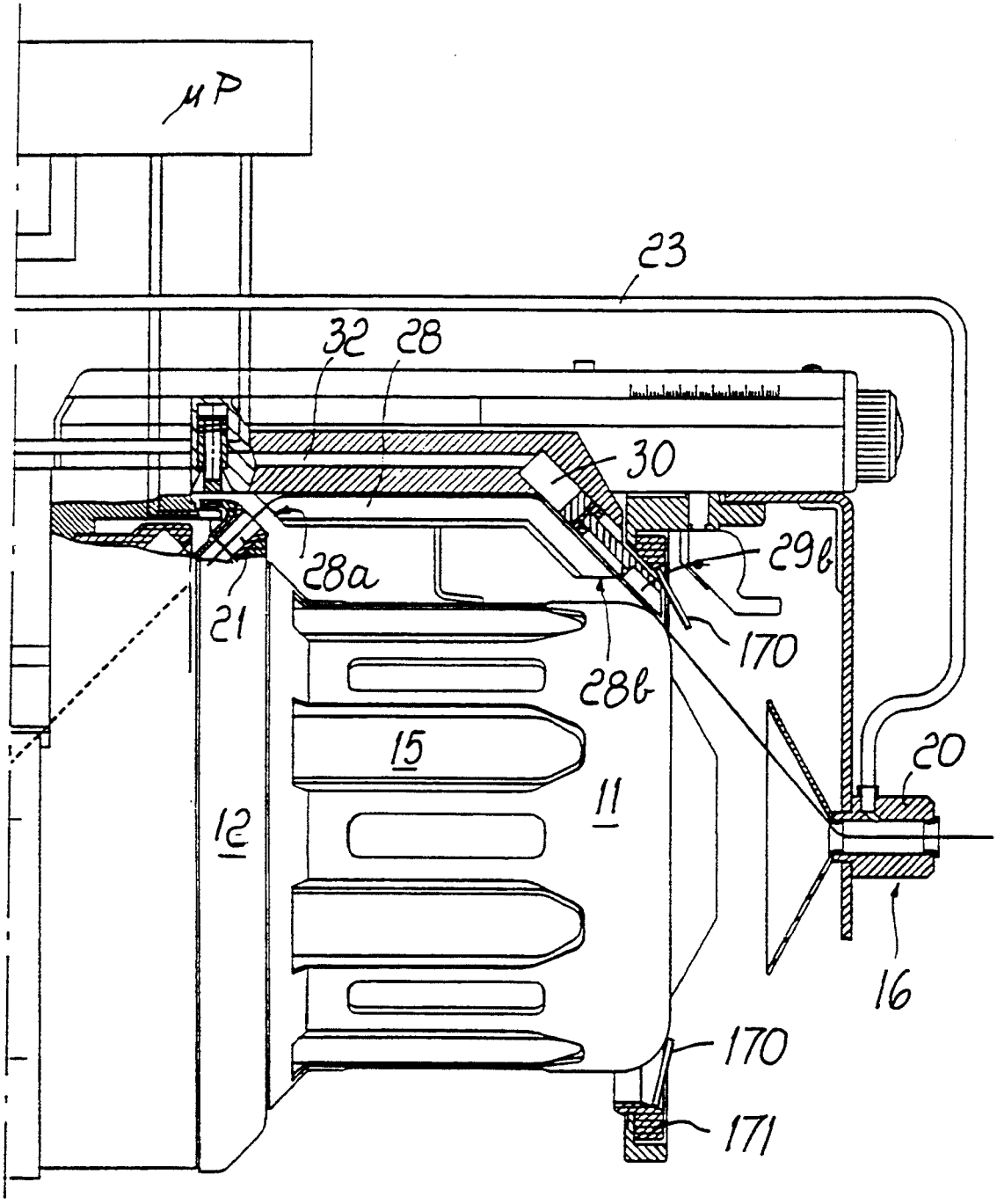
FIG. 6 is an elevation view, similar to FIG. 1, of a different type of weft feeder with the device according to the invention.

The variation shown in FIG. 6 differs in that the braking means of the apparatus 10 is constituted by a ring of bristles 170 supported by a ring 171 which surrounds the drum 11; the pusher element 29 acts on a portion of said bristles in a manner similar to what has been described above.

More precisely, in the above mentioned figure it can be seen that the U-shaped finger **29*b* penetrates between the bristles 170 with its convex dorsal part, deforming some said bristles and spacing them from contact with the drum 11, at the outlet section of the channel 28; the concave U-shaped finger 29*b* constitutes, when the pusher 29 is in active position, an extension of the channel 28 through the braking element 170** as regards both the conveyance of the flow and the guiding of the thread F.

Naturally, without altering the concept of the invention, the details of execution and the embodiments may be altered extensively with respect to what is described and illustrated by way of non-limitative example without thereby abandoning the scope of the invention.

We claim:

1. Electropneumatic device for automatically threading weft feeder apparatuses of the type comprising a fixed drum, a hollow rotating radial arm, braking means elastically engaging the drum, and thread inlet and outlet bushes, said device comprising;

first and second ducts for feeding pressurized pneumatic fluid and adapted to end respectively in a rear thread inlet bush and in a front thread outlet bush of a weft feeder apparatus to create a pneumatic flow and a consequent suction current for entraining said thread from one end of the weft feeder apparatus to the other;

manually actuated valve means acting on said first and second ducts;

an intermediate open channel having an outlet, said intermediate channel being arrangeable adjacent and parallel to a drum of a weft feeder apparatus for conveying a pneumatic flow, and a thread entrained thereby, in a free portion comprised between a radial arm outlet and a braking means of a weft feeder apparatus;

a pneumatic pusher fed by a third pneumatic duct, said pusher being arranged at said outlet of said intermediate channel for deforming a braking means and hindering elastic action applied by said braking means to a drum of a weft feeder apparatus, and for guiding thread entrained by a pneumatic flow through such braking means, and;

position-marking means for aligning a radial arm outlet of a weft feeder apparatus with said intermediate channel, whereby to convey pneumatic flow and guide thread entrained thereby upon activating said device for automatically threading weft feeder apparatuses, wherein said intermediate channel has a U-shaped profile having an opening, said intermediate channel being arrangeable with said opening directed toward and adjacent to a drum of a weft feeder apparatus.

2. Device according to claim 1, wherein said intermediate channel has an inlet section and an outlet section arrangeable, respectively, adjacent to a radial arm outlet and adjacent to a braking means of a weft feeder apparatus, and wherein said outlet section is inclined along a tangent to a drum and passing substantially through a coupling point of a braking means of a weft feeder apparatus.

3. Device according to claim 1, wherein said outlet of said intermediate channel includes an outlet section, said outlet section being arrangeable adjacent to a braking means of a weft feeder apparatus, and wherein said pneumatic pusher is adapted for acting on a braking means of a weft feeder apparatus.

4. Device according to claim 1, wherein said intermediate channel defines a pneumatic cylinder, and wherein said pneumatic pusher comprises;

a plunger slideable in said pneumatic cylinder;

a stem connected to said plunger and defining a concave U-shaped finger, said finger being adapted for engaging, deforming and moving braking means of a weft feeder apparatus out of contact with a drum thereof, for conveying pneumatic flow and guiding thread entrained by said pneumatic flow through such braking means.

5. Device according to claim 4, wherein said concave U-shaped finger is adapted for defining, when the pusher is in an active position, an extension of said intermediate channel through a braking means of a weft feeder apparatus.

6. Device according to claim 1, wherein said position-marking means are electromagnetic and include a movable pin having a free end and adapted to be rigidly coupled to a body of a weft feeder apparatus, said pin being subjected to a field of a movement coil, said free end comprising a first magnet having a preset polarity and interacting with a second magnet having an opposite polarity and being supportable by a rotating ring of a weft feeder apparatus, and wherein said first and second magnets define an active position, and wherein said first and second magnets face each other and are mutually spaced apart in said active position.

7. Device according to claim 6, wherein said first magnet interacts with a proximity sensor, said proximity sensor being arranged adjacent said second magnet, said sensor including means for disconnecting power supply from a weft feed apparatus in the presence of said first magnet.

8. Device according to claim 1, further comprising a piezoelectric sensor, said piezoelectric sensor being accommodatable in an inlet bush of a weft feeder apparatus, sensitive to tension of a thread, and adapted for stopping a weft feeder apparatus upon detecting an absence of tension.

9. Weft feeder apparatus for textile machines, comprising:

a drum for winding turns of thread constituting a weft reserve;

a rotating ring supporting a rotating hollow radial arm, said radial arm winding thread on said drum upon rotation of said ring;

braking means for braking said thread and acting in elastic contact engagement with said drum;

thread inlet and outlet bushes arranged coaxially to said drum;

a pair of ducts for feeding a pressurized pneumatic fluid into said bushes and creating a flow of pneumatic fluid passing through said weft feeder apparatus to pass the thread therethrough;

a monostable valve for cutting off said pressurized pneumatic fluid fed into said pair of ducts;

an intermediate channel-shaped duct having a U-shaped profile, said intermediate channel-shaped duct being interposed between said rotating radial arm and said braking means and arranged parallel and adjacent to said drum, whereby to convey said pressurized pneumatic fluid, and guide said thread entrained thereby;

a pneumatic pusher element fed by a third pneumatic duct, said third pneumatic duct being controlled by said valve means and acting on said braking means, said pneumatic pusher element deforming said braking means and moving said braking means away from contact with said drum for allowing passage of said pressurized pneumatic fluid and said thread conveyed thereby through said braking means, and;

magnetic position-marking means for stopping said rotating ring and said hollow radial arm in alignment with said intermediate channel-shaped duct, wherein said braking means are constituted by an elastic membrane and a semirigid conical element, said conical element having a free end and being supported and pushed into elastic contact engagement against said drum by said elastic membrane, said conical element defining a greatest circumference, and being tangent to said drum at a portion thereof located adjacent said greatest circumference;

wherein said intermediate channel-shaped duct defines an outlet section, said outlet section being substantially inclined and extending parallel to generatrices of said conical element, said pneumatic pusher element having a stem, said stem having a U-shaped hollow terminal finger, said terminal finger being inclined substantially along said generatrices of said conical element and arranged adjacent to said free end of said conical element, and;

wherein said U-shaped finger is chamfered by a radial cut, said radial cut acting as an inclined plane for deforming said free edge of said conical element; said concave U-shaped terminal finger constituting, when the pusher element is in an active position, an extension of said intermediate channel-shaped duct passing through said braking means.

10. Weft feeder apparatus according to claim 9, wherein said braking means is constituted by a ring surrounding said drum and a ring of bristles supported by said ring, and;

wherein said bristles elastically engage a surface of said drum, said pneumatic pusher element being arranged adjacent said ring at a side thereof directed toward said intermediate channel-shaped duct, said pusher element being provided with a stem, said stem having a concave U-shaped terminal finger defining a convex dorsal part, said convex dorsal part of said terminal finger engaging and elastically deforming a corresponding portion of said bristles whereby to space said bristles from contact with said drum in an active position of said pneumatic pusher element, and;

wherein said concave U-shaped finger constitutes, when said pneumatic pusher element is in said active position, an extension of said intermediate channel-shaped duct passing through said ring of bristles.

11. Electropneumatic device for automatically threading weft feeder apparatuses of the type comprising a fixed drum, a hollow rotating radial arm, braking means elastically engaging the drum, and thread inlet and outlet bushes, said device comprising;

first and second ducts for feeding pressurized pneumatic fluid and adapted to end respectively in a rear thread inlet bush and in a front thread outlet bush of a weft feeder apparatus to create a pneumatic flow and a consequent suction current for entraining said thread from one end of the weft feeder apparatus to the other;

manually actuated valve means acting on said first and second ducts;

an intermediate open channel having an outlet, said intermediate channel being arrangeable adjacent and parallel to a drum of a weft feeder apparatus for conveying a pneumatic flow, and a thread entrained thereby, in a free portion comprised between a radial arm outlet and a braking means of a weft feeder apparatus;

position-marking means for aligning a radial arm outlet of a weft feeder apparatus with said intermediate channel, whereby to convey pneumatic flow and guide thread entrained thereby upon activating said device for automatically threading weft feeder apparatuses, and;

a pneumatic pusher fed by a third pneumatic duct;

wherein said pusher is arranged at said outlet of said intermediate channel for deforming a braking means, to create a space between said braking means and a drum of a weft feeder apparatus for allowing passage of said thread entrained by said pneumatic flow, and for hindering elastic action applied by said braking means to a drum of a weft feeder apparatus, and wherein said pusher defines an extension of said intermediate channel for guiding thread entrained by a pneumatic flow through such braking means.

12. Device according to claim 11, wherein said intermediate channel has a U-shaped profile having an opening, said intermediate channel being arrangeable with said opening directed toward and adjacent to a drum of a weft feeder apparatus.

13. Device according to claim 11, wherein said intermediate channel has an inlet section and an outlet section arrangeable, respectively, adjacent to a radial arm outlet and adjacent to a braking means of a weft feeder apparatus, and wherein said outlet section is inclined along a tangent to a drum and passing substantially through a coupling point of a braking means of a weft feeder apparatus.

14. Device according to claim 11, wherein said outlet of said intermediate channel includes an outlet section, said outlet section being arrangeable adjacent to a braking means of a weft feeder apparatus, and wherein said pneumatic pusher is adapted for acting on a braking means of a weft feeder apparatus.

15. Device according to claim 11, wherein said intermediate channel defines a pneumatic cylinder, and wherein said pneumatic pusher comprises;

a plunger slideable in said pneumatic cylinder;

a stem connected to said plunger and defining a concave U-shaped finger, said finger being adapted for engaging, deforming and moving braking means of a weft feeder apparatus out of contact with a drum thereof, for conveying pneumatic flow and guiding thread entrained by said pneumatic flow through such braking means.

16. Device according to claim 15, wherein said concave U-shaped finger is adapted for defining, when the pusher is in an active position, an extension of said intermediate channel through a braking means of a weft feeder apparatus.

17. Device according to claim 11, wherein said position-marking means are electromagnetic and include a movable pin having a free end and adapted to be rigidly coupled to a body of a weft feeder apparatus, said pin being subjected to a field of a movement coil, said free end comprising a first magnet having a preset polarity and interacting with a second magnet having an opposite polarity and being supportable by a rotating ring of a weft feeder apparatus, and wherein said first and second magnets define an active position, and wherein said first and second magnets face each other and are mutually spaced apart in said active position.

18. Device according to claim 17, wherein said first magnet interacts with a proximity sensor, said proximity sensor being arranged adjacent said second magnet, said sensor including means for disconnecting power supply from a weft feed apparatus in the presence of said first magnet.

19. Device according to claim 11, further comprising a piezoelectric sensor, said piezoelectric sensor being accommodatable in an inlet bush of a weft feeder apparatus, sensitive to tension of a thread, and adapted for stopping a weft feeder apparatus upon detecting an absence of tension.

* * * * *